US010460860B2

(12) United States Patent
Stottinger et al.

(10) Patent No.: US 10,460,860 B2
(45) Date of Patent: Oct. 29, 2019

(54) CONTROLLABLE ROTARY KNOB

(71) Applicant: ZULU OG, Villach (AT)

(72) Inventors: Ernst Stottinger, Vienna (AT); Michael Sternad, Klagenfurt a.W (AT)

(73) Assignee: ZULU OG, Villach (AT)

( * ) Notice: Subject to any disclaimer, the term of this patent is extended or adjusted under 35 U.S.C. 154(b) by 0 days.

(21) Appl. No.: 16/330,023

(22) PCT Filed: Sep. 1, 2017

(86) PCT No.: PCT/EP2017/071946
§ 371 (c)(1),
(2) Date: Mar. 1, 2019

(87) PCT Pub. No.: WO2018/041991
PCT Pub. Date: Mar. 8, 2018

(65) Prior Publication Data

US 2019/0198202 A1 Jun. 27, 2019

(30) Foreign Application Priority Data

Sep. 2, 2016 (EP) ..... 16187009

(51) Int. Cl.

| | |
|---|---|
| ***H01C 10/14*** | (2006.01) |
| ***G05G 1/12*** | (2006.01) |
| ***H01H 19/20*** | (2006.01) |
| ***G05G 1/10*** | (2006.01) |

(52) U.S. Cl.
CPC ..... *H01C 10/14* (2013.01); *G05G 1/105* (2013.01); *G05G 1/12* (2013.01); *H01H 19/20* (2013.01)

(58) Field of Classification Search
CPC ..... H01C 10/14; H01H 19/20; G05G 1/12
See application file for complete search history.

(56) References Cited

U.S. PATENT DOCUMENTS 3,754,106 A * 8/1973 MacDonald ..... H01H 9/165 200/14
7,202,428 B2 * 4/2007 Ogawa ..... G05G 1/105 200/308

(Continued)

FOREIGN PATENT DOCUMENTS

| | | |
|---|---|---|
| CN | 204046795 U | 12/2014 |
| EP | 2544068 A1 | 1/2013 |
| WO | 2012/012817 A1 | 2/2012 |

OTHER PUBLICATIONS

International Search Report dated Sep. 26, 2017 from International Patent Application No. PCT/EP2017/071946 filed Sep. 1, 2017.

(Continued)

*Primary Examiner* — Kyung S Lee
(74) *Attorney, Agent, or Firm* — Workman Nydegger

(57) ABSTRACT

A controllable rotary knob including at least one base, at least one drive unit rigidly connected to the base, at least one transmission, and an operating part, and the operating part is configured as a housing surrounding the drive unit and the transmission, and the transmission establishes a connection between the drive unit and the operating part, wherein the drive unit has an axially symmetric structure and the drive unit and the operating element are arranged coaxially to one another.

16 Claims, 5 Drawing Sheets

(56) References Cited

U.S. PATENT DOCUMENTS

Figure 1B:
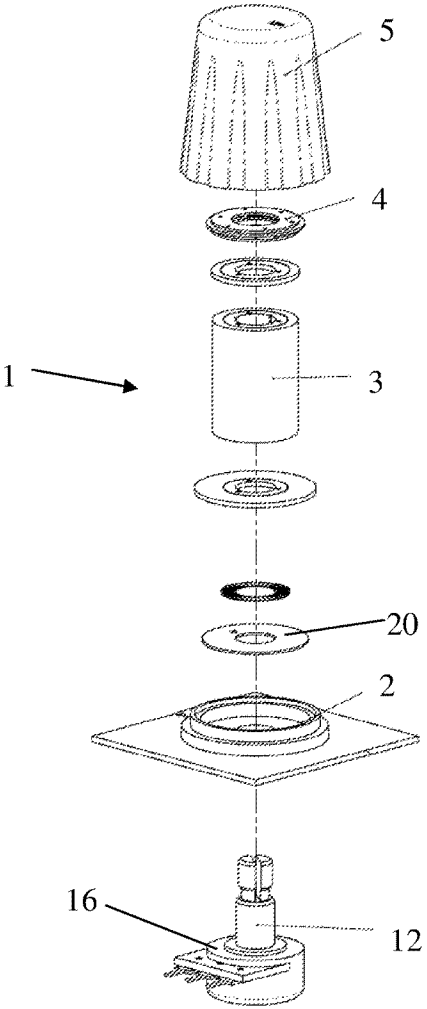

| | | | | |
|---|---|---|---|---|
| 7,238,904 | B2 * | 7/2007 | Ogawa | B60H 1/0065 200/336 |
| 7,745,749 | B2 * | 6/2010 | Ito | B60R 11/0264 200/316 |
| 8,350,731 | B2 * | 1/2013 | Kato | H01H 25/008 250/231.14 |
| 9,728,356 | B2 * | 8/2017 | Levay | B60K 37/06 |

OTHER PUBLICATIONS

International Preliminary Report on Patentability dated Aug. 28, 2018 from International Patent Application No. PCT/EP2017/071946 filed Sep. 1, 2017.

* cited by examiner

CONTROLLABLE ROTARY KNOB

The present application is a U.S. National Stage of International Application No. PCT/EP2017/071946, filed on Sep. 1, 2017, designating the United States and claiming the priority of European Patent Application No. EP 16187009.2 filed on Sep. 2, 2016. All of the aforementioned applications are incorporated herein in their respective entireties by this reference.

The invention relates to a controllable rotary knob which comprises at least one base, at least one drive unit rigidly connected to the base, at least one transmission, and an operating part, wherein the operating part is configured as a housing surrounding the drive unit and the transmission.

Such a controllable rotary knob is used, for example, as an attachment for rotary potentiometers or rotary switches. Those elements are electrotechnical components which are adjustable by a mechanical rotary motion. They have a shaft which, for example in case of a rotary potentiometer, is combined with a potentiometer. The electric resistance of the potentiometer can be varied by mechanically rotating the rotary shaft, permitting its use as a control element for electronic devices. For example, digital rotary knobs are also available on the market which adhere to the same principle of mechanical adjustment. Rotary knobs of this type are used for controlling a multitude of parameters, depending on the respective application, such as sound volume, temperature, signal level, power, etc.

However, the necessary manual control of such rotary knobs gives rise to the challenge that a quick and user-friendly control and regulation of all parameters controlled by rotary knobs is impossible especially when electronic devices are used which have a multitude of rotary knobs, such as, for example, audio mixing consoles, audio effect devices, some musical instruments or switch panels and input interfaces in industrial and manufacturing plants. Furthermore, it is complicated to reproduce a previous state by manually setting a multitude of rotary knobs.

So as to solve this problem, document AT 510249 B1 discloses a controllable control dial which is attached to the shaft of a rotary knob and connected to the housing of the electronic device on which the control dial is applied. It has a drive unit as well as a transmission which allows the control dial to be set by the user without manual operation in an automated and remote-controlled way. The control dial disclosed in AT 510249 B1 provides the possibility to be used in a system of a multitude of identical control dials and thus also to perform complex settings on devices.

The fact that the motor and further components require a lot of space within the rotary knob has turned out to be a disadvantage of such constructions. As a result, the external dimensions are increased, which negatively affects the appearance. Furthermore, the attachment on devices with small distances between the rotary knobs or with a specification of low installation heights is made more difficult.

It is the object of the present invention to build a controllable rotary knob which avoids the disadvantages of the above-mentioned construction.

According to the invention, the present object is achieved in that the transmission establishes a connection between the drive unit and the operating part, wherein the drive unit has an axially symmetric structure and the drive unit and the operating element are arranged coaxially to one another.

Due to the axially symmetric structure of the drive unit and the coaxial arrangement of the drive unit and the operating element, the advantage is obtained that the space within the operating part designed as a housing is utilized optimally. As a result, it is advantageously rendered possible to reduce the dimensions of the controllable rotary knob according to the invention in comparison to conventional controllable rotary knobs. It is possible that the connection with the rotary shaft is concentric. Due to the axially symmetric structure of the drive unit, it is possible to design either the rotor or the stator internally, near the shaft of the rotary knob.

For connecting the controllable rotary knob according to the invention to the shaft of a conventional rotary knob, in one embodiment, a connecting element is present in the controllable rotary knob which, due to its variable design, provides the possibility to accommodate shafts of various external dimensions and shapes. Said element is likewise designed coaxially to the drive unit.

Furthermore, the design of the transmission as a planetary gear allows to realize a variable gear ratio between the drive unit, the operating part and the connecting element. In this way, the advantage is provided that, by selecting the gear ratio, the shaft of the rotary knob can be actuated very sensitively either manually by turning the operating part or in an automated fashion by means of the drive unit. A further gear ratio of the transmission through a gear ratio of the planet gear is possible, wherein the number of teeth of the planet gear on which the ring gear engages is unlike that where the sun gear engages.

In this connection, it is particularly advantageous that the possibility is created for the user to manually bypass an automated setting at any time by means of the drive element. A mechanical connection exists between the operating part and the seat of the shaft, which connection is not defined via the transmission and allows operation even when the rotary knob is in an electrically de-energized state. This operation is feasible in the same direction of rotation with a gear transmission ratio of 1:1 between the operating part and the seat of the shaft.

The operating part of the controllable rotary knob according to the invention, which is designed as a housing, is in releasable connection with the transmission. This construction advantageously enables the operating part to be removable and the operating part to be replaced with a substitute which, for example, has an alternative colour or surface finish or is made of an alternative material.

Advantageous embodiments of the controllable rotary knob according to the invention and alternative embodiments will be explained in more detail hereinbelow with reference to the figures.

Figure 1A:
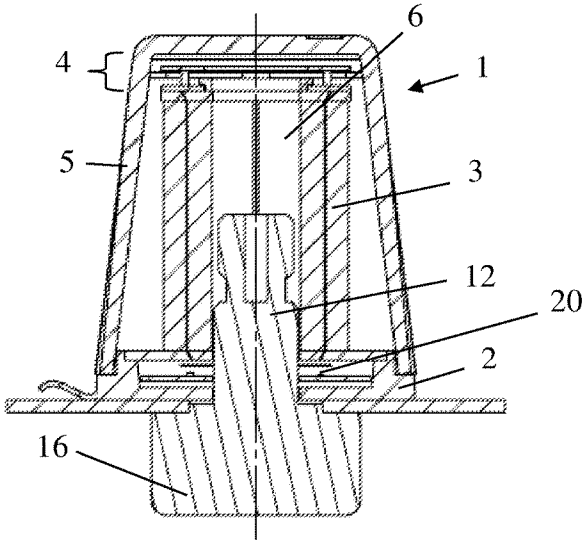

FIG. 1*a* shows a section through the centre plane of a controllable rotary knob according to the invention.

FIG. 1*b* shows an exploded drawing in isometric view of a controllable rotary knob according to the invention of FIG. 1*a*.

Figure 2:
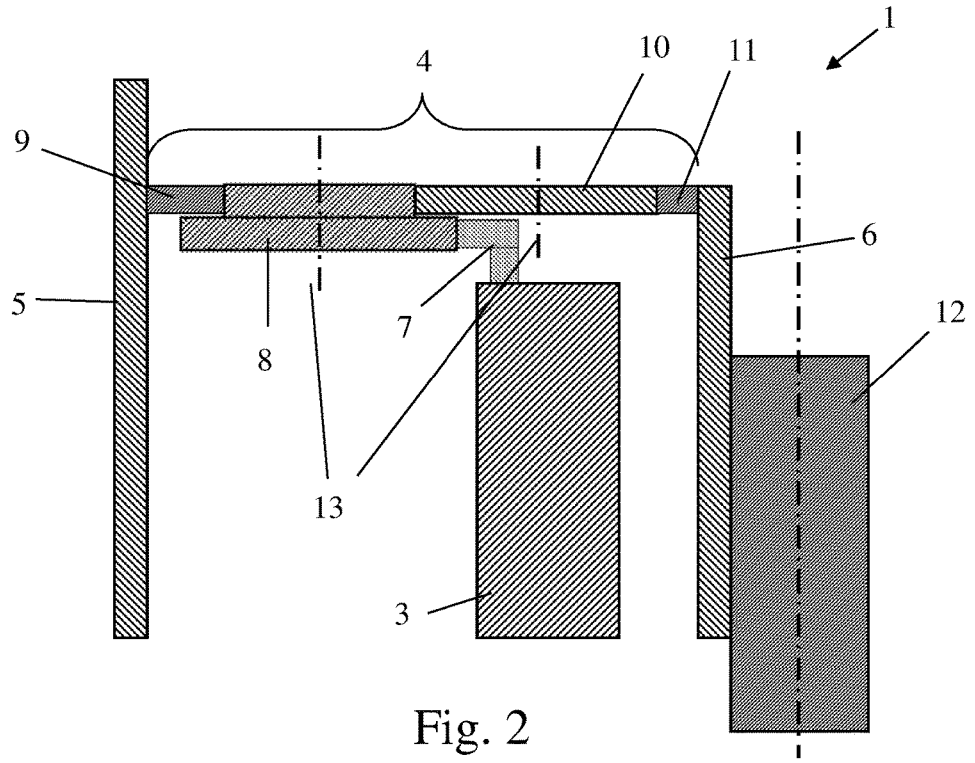

FIG. 2 shows a detail of a controllable rotary knob according to the invention in a schematic illustration with a transmission, a drive unit, a housing and a connecting element.

Figure 3B:
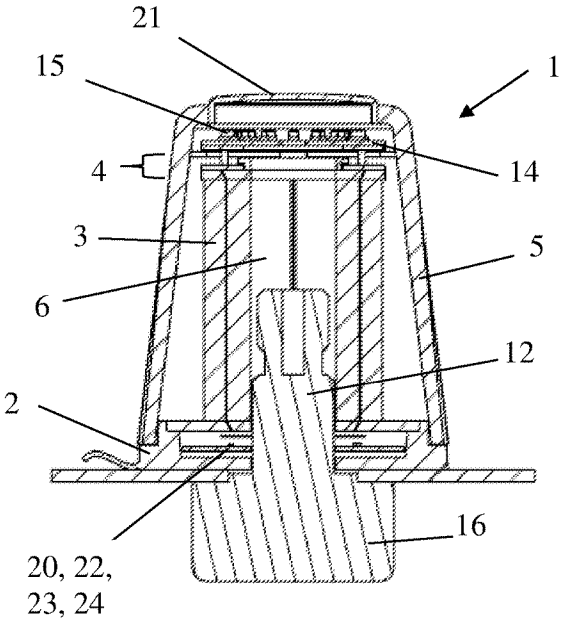
Figure 3A:
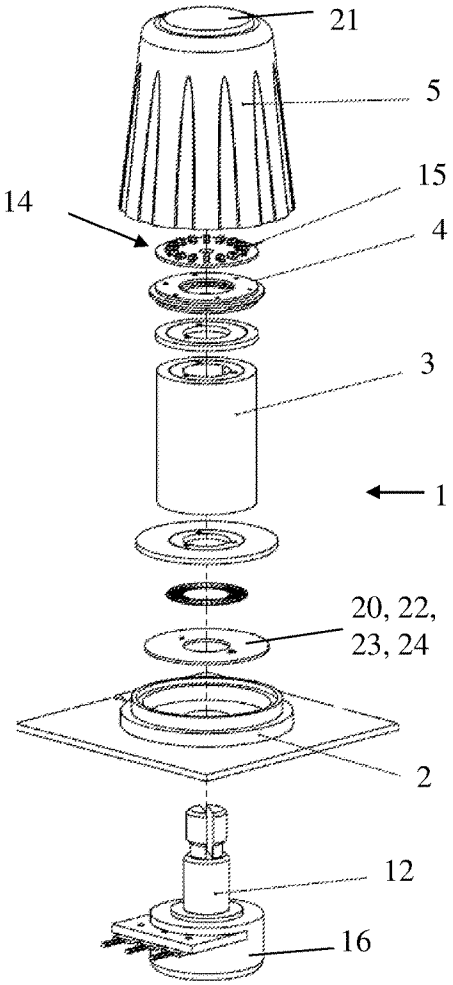

FIG. 3*a* shows an exploded drawing of a controllable rotary knob according to the invention in isometric view with an integrated display and input element.

FIG. 3*b* shows a section through the centre plane of the controllable rotary knob illustrated in FIG. 3*a*.

Figure 4B:
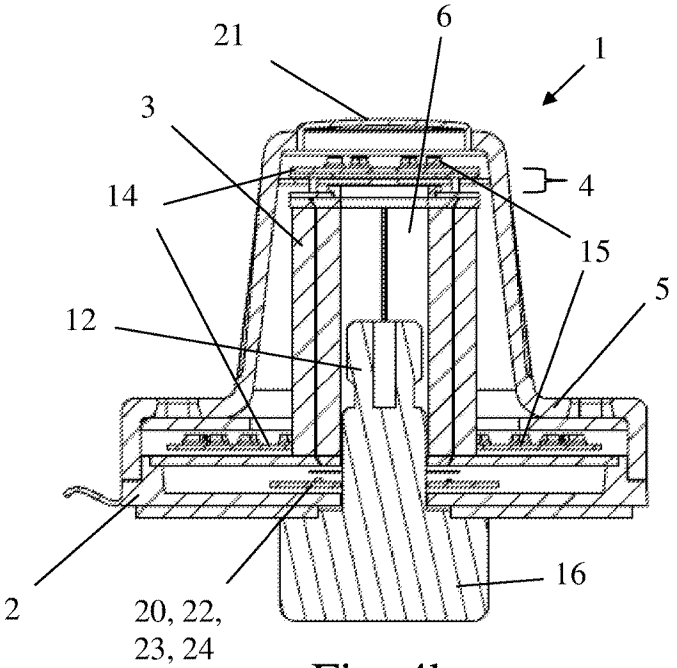
Figure 4A:
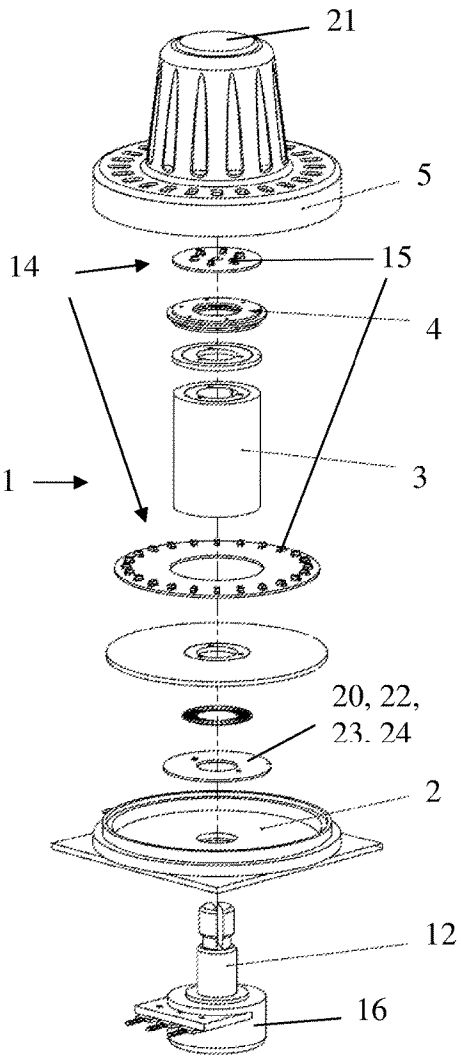

FIG. 4*a* shows an exploded drawing in isometric view of an alternative embodiment of a controllable rotary knob according to the invention.

FIG. 4*b* shows a section through the centre plane of the controllable rotary knob illustrated in FIG. 4*a*.

Figure 5B:
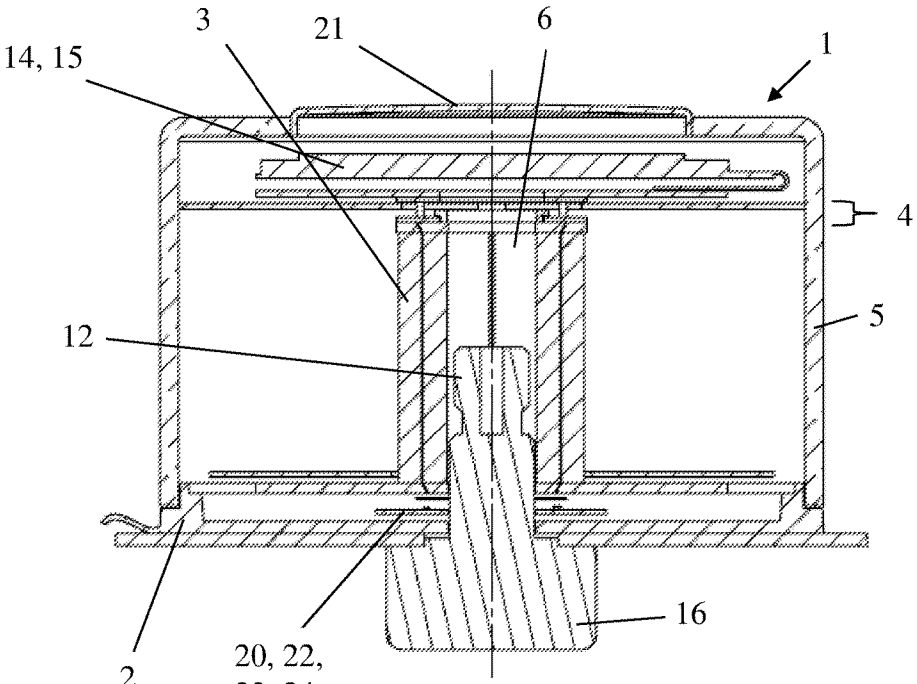
Figure 5A:
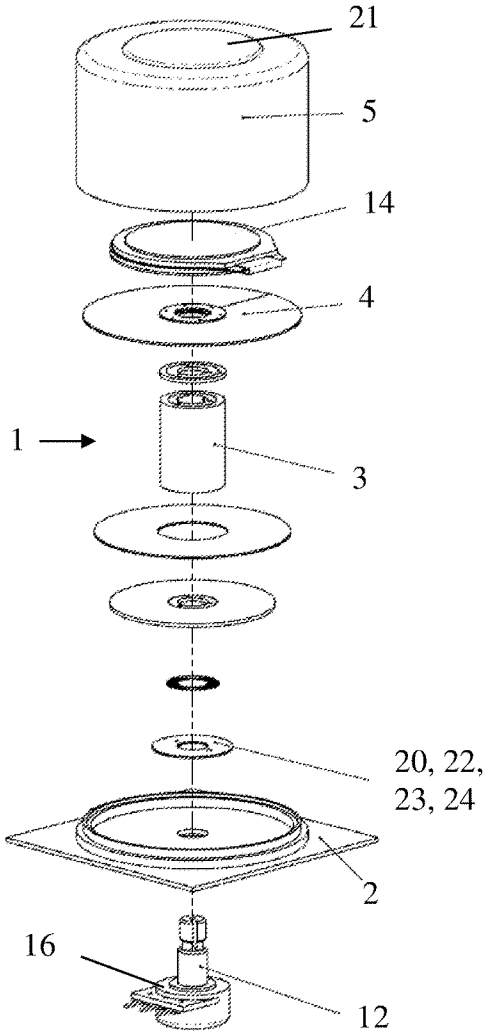

FIG. 5*a* shows an exploded drawing in isometric view of a further alternative embodiment of a controllable rotary knob according to the invention.

FIG. 5*b* shows a section through the centre plane of the controllable rotary knob illustrated in FIG. 5*a*.

Figure 6:
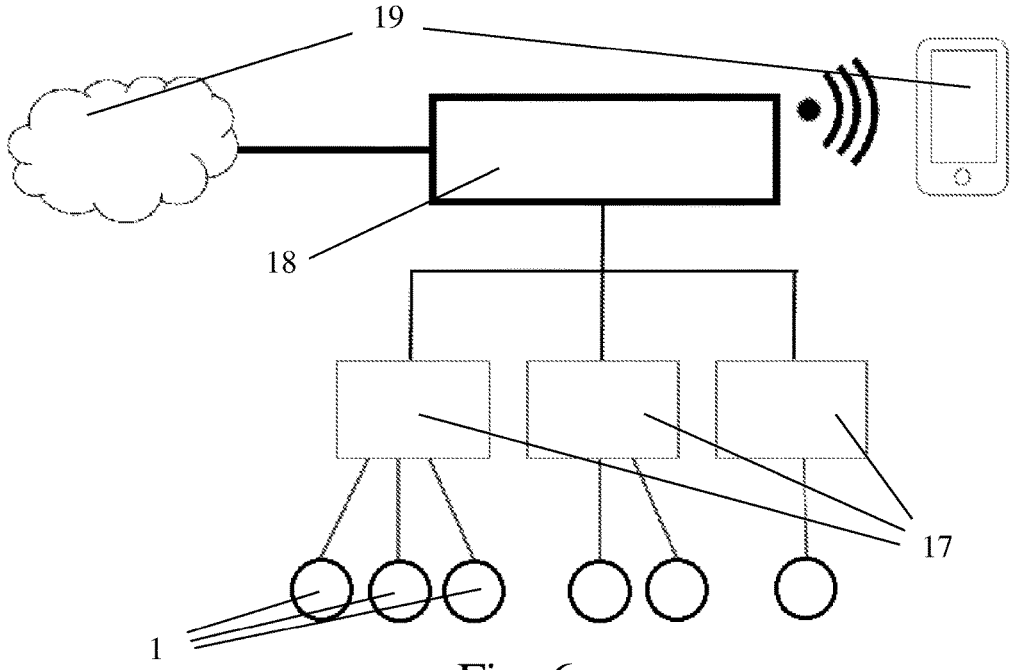

FIG. 6 shows a schematic view of the application of a multitude of rotary knobs according to the invention with a network connection according to an embodiment.

FIG. 1*a* shows a section through the controllable rotary knob 1 according to the invention according to a preferred embodiment with a base 2, which is rigidly connected to a drive unit 3, a transmission 4, which, in the illustrated preferred embodiment, is depicted at the end of the drive unit 3 opposite to the base 2, an operating part 5, which is designed as a housing surrounding the remaining elements of the controllable rotary knob 1, as well as a connecting element 6, which is arranged in the central axis of the controllable rotary knob 1. It should be mentioned that the transmission 4 can also be arranged in the vicinity of the base 2.

The connecting element 6 has a shape which allows a rotary knob shaft 12, for example of a rotary potentiometer, to be accommodated by the connecting element 6. Different design shapes of the connecting element 6 advantageously allow accommodation of shafts 12 with different shapes and dimensions such as, for example, PTO shafts, shafts with grooves, etc.

The base 2 serves for securing the controllable rotary knob 1 on the surface of the device to be controlled. This can be accomplished, for example, by means of gluing, screws, rivets, suction cups or in a magnetic fashion. Other fastening options will be apparent to the person skilled in the art from this exemplary reference. In this way, the controllable rotary knob 1 can be mounted on different surfaces even without the need of, for example, mounting holes.

The drive unit 3 illustrated in FIG. 1 is a hollow-shaft DC motor the axially symmetric structure of which makes it possible to arrange the drive unit 3 coaxially around the connecting element 6.

According to an alternative embodiment, instead of a hollow-shaft DC motor, a number of stepping, synchronous or asynchronous motors can be arranged at regular intervals around the central axis of the controllable rotary knob 1, with the drive shafts of those motors being connected to the transmission 4, which allows greater flexibility in choosing the modes of driving.

The axially symmetric design of the drive unit 3 provides the advantage that the available space within the operating part 5 can be utilized optimally, whereby a reduction in the installation size of the controllable rotary knob 1 is achieved.

FIG. 1*b* shows an exploded drawing of a controllable rotary knob according to FIG. 1*a*, wherein a rotary switch 16 with an associated shaft 12 is exemplified, onto which the controllable rotary knob 1 according to the invention is placed. The connecting element 6 (see FIG. 1*a*) is concealed in this illustration by the casing of the operating part 5 and is thus not shown. The mechanical connection between the operating part 5 and the connecting element 6 (see FIGS. 1*a* and 1*b*) is not depicted to provide a better overview.

FIG. 2 shows a detail of a controllable rotary knob 1 according to the invention in a schematic illustration, wherein a preferred embodiment of the controllable rotary knob 1 with a transmission 4 in the form of a two-stage planetary gear and a hollow-shaft stepping motor as a drive unit 3 is shown. The use of a planetary gear allows a particularly space-saving accommodation of the transmission 4 in the available space within the operating part 5.

In the illustrated embodiment, the rotor of the drive unit 3 is connected to a first sun gear 7. The latter engages with a first planet gear 8. The first planet gear 8 engages with a ring gear 9 which is connected to the operating part 5, whereby the rotational movement of the drive element 3 is transmitted onto the operating part 5.

According to an alternative embodiment, the operating part 5 can have a gear-shaped design on its inside in the contact plane with the first planet gear 8 as a substitute for the ring gear 9. Those design options for the operating part 5 provide the advantage that said part is separable from the transmission 4 and can be replaced with alternative operating parts 5 which, for example, have an alternative colour or surface finish or with operating parts 5 made of an alternative material.

In FIG. 2, a second planet gear 10 engages the first planet gear 8 on the side of the first planet gear 8 opposite to the ring gear 9 and transmits the rotational movement onto a second sun gear 11, which is connected to the connecting element 6.

According to an alternative embodiment, the function of the second sun gear 11 is ensured by a gear-shaped design of the connecting element 6 in the plane of the second planet gear 10.

By choosing the gear ratio of the planetary gear, a particularly delicate control of the rotary motion of the rotary knob shaft 12 is enabled, which allows different gear ratios between the operating part 5, the drive unit 3 and the connecting element 6 or, respectively, the rotary knob shaft 12 if a two-stage planetary gear is used, as shown in FIG. 2.

If DC motors or asynchronous motors are used in alternative embodiments, the function of the first sun gear 7 is assumed either by a direct connection of the drive shafts in each case to one first planet gear 8 assigned to each motor or by means of a gear-shaped design of the drive shafts of the DC or asynchronous motors. In an alternative embodiment, a direct connection of the drive shafts of the motors to the first planet gear 8 is realized, wherein this flexibility with regard to the options of connecting the drive unit 3 to the transmission 4 enables the use of the aforementioned different modes of driving.

Alternative embodiments are also possible, for example, using a single-stage planetary gear, in which the second planet gear 10 is omitted and a direct connection exists between the operating element 5 and the connecting element 6.

In a further alternative embodiment, the drive shafts can be engaged directly into the stationary planet gears or onto a common sun gear.

Due to the rigid connection of the transmission 4, the operating part 5, the drive unit 3 and the connecting element 6, the possibility is advantageously created for the user to manually bypass an automated setting at any time by means of the drive element 3. In addition, this allows to ensure the perpetuation of the functionality of a conventional rotary knob in the event of a failure in the power supply of the controllable rotary knob 1. The planet gears of the transmission 4 have an axis of rotation 13 which is fixed with regard to the base 2, whereby the routing of cables for the purpose of energy supply and data transmission within the controllable rotary knob 1 is simplified. Especially the advantage that no mechanical connection between the operating part 5 and the connecting element 6 is necessary allows, for example, to implement cable routings between the planet gears, without fear of collision between the planet gear, the cable which has been guided through and the mechanical connection between the operating part 5 and the connecting element 6 at angles of rotation close to or, respectively, above 360 degrees. In this variant, separate mounting of operating part 5 and connecting element 6 is necessary.

FIG. 3*a* shows an exploded drawing of a controllable rotary knob 1 according to the invention in isometric view with a base 2, a drive unit 3, a transmission 4 in the form of a planetary gear, a removed operating part 5 and a display and input unit 14 with associated display elements 15. Furthermore, a rotary switch 16 with a rotary knob shaft 12 is exemplified, onto which the controllable rotary knob 1 is placed.

In the illustrated embodiment, the operating part 5 has a transparent surface 21 at the end opposite to the base 2 in the assembled state. Directly adjacent to this surface 21, the display and input unit 14 is located within the operating part 5, which display and input unit includes a number of display elements 15 in the illustrated embodiment, which are visible through the transparent surface 21. The display and input unit 14 serves for controlling the display elements 15 on the basis of display information transmitted to the display and input unit 14.

According to an alternative embodiment, the display and input unit 14 contains, besides, in addition to or instead of display elements 15, at least one input element which responds to touches from the user, whereby input information is generated by the display and input unit 14 in a user interaction with the input element. The display element 15 may be designed, for example, as an LED ring, an eReader display, an OLED display or a TFT display. Furthermore, the display element 15 may comprise a speaker. The input unit may be, for example, a touch operating panel, a proximity sensor, a sensing device, a fingerprint sensor, a camera, a microphone or a switch. The display and input unit 14 can also be arranged in the vicinity of the base 2, as illustrated in FIG. 4*a*.

In this way, it is made possible that, besides the input option by turning the controllable rotary knob 1 as described hereinbelow, a further input option is created additionally, and, beyond that, an optical representation of the state, of relevant information such as images, text or the like, or, respectively, of the setting of the controllable rotary knob 1 is created. Furthermore, graphic patterns can be indicated by the display element 15, which graphic patterns can be used for augmented reality applications. The current function of the rotary knob 1 can thereby be read out and determined, for example, by a camera. In addition to the graphic patterns, which are illustrated, e.g., in one colour, a second colour can be provided by coloured lighting elements for the output of information.

According to a further embodiment, the display and input unit 14 may further include a camera and/or a microphone as input elements for generating input information. As a result, the possibility is created to realize a proximity sensor by means of the camera, wherein the camera can be used for detecting the approach of an object such as, for example, the hand of a user. This leads to an additional input option, which can be used, for example, for actuating the rotary knob 1. In addition, the camera may be used for providing eye recognition and the microphone may be used as an input device for input information generated by voice recognition, whereby feedback can be output via the display element 15. In this way, the possibility is created to control the rotary knob 1 according to the invention without contact by voice commands.

Furthermore, the controllable rotary knob 1 illustrated in FIG. 3*a* includes, according to an embodiment, a position encoder unit 20 which is connected either to the operating part 5, the transmission 4, the rotor of the drive unit 3 or the connecting element 6, which is not illustrated in FIG. 3*a*. This position encoder unit serves for generating position information mapping the respective current position of the individual elements of the controllable rotary knob 1. The position encoder unit 20 thus also serves for detecting changes in the position of the operating part 5, caused by twisting performed by the user. The position encoder unit 20 can be arranged both in the vicinity of the base 2 and at the end of the drive unit 3 opposite to the base. It is possible to use absolute and relative position detections.

In addition, a control unit 22 is provided which controls the drive unit 3 on the basis of control information in order to effect a change in the position of the drive unit 3 and the components of the controllable rotary knob 1 which are connected thereto via the transmission 4.

In addition, the controllable rotary knob 1 comprises a communication unit 23 and a controlling unit 24.

In this case, the controlling unit 24 is connected to the position encoder unit 20, the control unit 22, the display and input unit 14 and the communication unit 23 and is configured for receiving position information from the position encoder unit 20, input information from the display and input unit 14 and control information, display information, position information as well as input information from the communication unit 23, for generating control information and display information and for transmitting control information to the control unit 22, display information to the display and input unit 14 and display information, position information, control information and input information to the communication unit 23. The control unit may comprise storage and arithmetic units. It is possible to mount the control unit 22, the communication unit 23 and the controlling unit 24 outside of the rotary knob 1 and to connect them to the rotary knob 1 for example in a wired manner.

The communication unit 23 serves for the exchange of control information, position information, display information and input information with the controlling unit 24 and for the wireless or, respectively, wired transmission of said information to a data network.

By equipping the controllable rotary knob 1 according to the invention with those above-mentioned components it is achieved that the controllable rotary knob 1 as a single controllable rotary knob 1 can be used on a rotary knob or, respectively, as part of a group of similar controllable rotary knobs 1, for example, on a mixing console or a different device with many rotary knobs. In an application as part of a group of controllable rotary knobs 1, complex control and setting tasks can be assumed by controllable rotary knobs 1 according to the invention by exchanging the above-mentioned data.

In the embodiment illustrated in FIG. 3*a*, the control unit 22, the communication unit 23 and the controlling unit 24 are located together with the position encoder unit 20 on a board below the drive unit 3. However, as illustrated, it is also possible to configure both the position encoder unit 20 and the other components which have been mentioned below the drive unit 3 as well as above it or in a combination thereof.

FIG. 3*b* shows a section through the centre plane of the controllable rotary knob illustrated in FIG. 3*a*. Herein, the connecting element 6 is likewise shown, which is concealed by the operating part 5 in FIG. 3*a*.

FIG. 4*a* shows an alternative embodiment of the controllable rotary knob 1, wherein, in comparison to FIG. 3*a*, a further display and input unit 14 comprising display elements 15 is arranged in the vicinity of the base 2 of the controllable rotary knob 1, which are visible from the outside through appropriate recesses in the operating part 5. According to an alternative embodiment, only one display and input unit 14 is present, which is arranged at the position of the lower display and input unit 14 in FIG. 4*a*.

FIG. 4*b* shows a section through the centre plane of the controllable rotary knob illustrated in FIG. 4*a*. Herein, the connecting element 6 is likewise shown, which is concealed by the operating part 5 in FIG. 4*a*. The mechanical connection between the operating part 5 and the connecting element 6 (see FIGS. 1*a* and 1*b*) is not shown to provide a better overview.

FIG. 5*a* shows a further alternative embodiment of the controllable rotary knob 1, wherein, in comparison to FIG. 3*a* and FIG. 4*a*, an alternative shape of the operating part 5 is used for accommodating a display and input unit 14, which is configured, for example, as a touch-sensitive OLED display, an eReader display, a TFT display, a touch operating panel and the like.

FIG. 5*b* shows a section through the centre plane of the controllable rotary knob illustrated in FIG. 5*a*. Herein, the connecting element 6 is likewise shown, which is concealed by the operating part 5 in FIG. 5*a*. The mechanical connection between the operating part 5 and the connecting element 6 (see FIGS. 1*a* and 1*b*) is not shown to provide a better overview.

It should be noted that, in the embodiments described above, adaptive activation of the display elements 15 at the different positions of the controllable rotary knob is enabled by integrating input elements into the controllable rotary knob, using one or several display elements 15 in the form of, for example, LED rings. In this case, for example, at least one of the display elements 15 changes its colour, is switched off or is switched on. Furthermore, depending on the design of the input element, a "click function" can be realized which provides the user with additional haptic feedback. The input may, for example, result in a change in the operating mode of the controllable rotary knob or trigger a software-controlled reaction.

FIG. 6 shows a schematic view of the application of a multitude of controllable rotary knobs 1 according to the invention on one or several devices, wherein each of the controllable rotary knobs 1 exchanges control information, position information, display information and input information with a common interface 17.

Those interfaces 17 are connected by a network connection to a network hub 18, which in turn forwards the data of the network from controllable rotary knobs 1 to a data network such as, for example, the internet, or is connected to an end device 19, for example, by means of Bluetooth or WLAN or a wired data connection. This may be either a desktop computer, a laptop or a mobile end device such as a mobile phone, tablet, etc. Further options arise for the person skilled in the art from this exemplary reference.

In the integration of communication devices in each of the controllable rotary knobs 1 of a group, the connection to an interface 17, as illustrated in FIG. 6, may be omitted. In this embodiment, the controllable rotary knobs 1 can be connected directly by means of a wired or wireless connection to a network hub 18 and subsequently to a data network such as, for example, the internet. For a completely wireless connection, each controllable rotary knob 1 must include an energy storage device, such as, e.g., a rechargeable battery, for this purpose. In this case, the controlling unit 24 acting as a control loop is realized either within each controllable rotary knob 1 of the group or, in alternative embodiments, is dislocated to the network hub 18 or the interface 17.

Furthermore, it is possible to realize communication among the controllable rotary knobs 1 by means of a network connection according to one of the above-mentioned embodiments. As a result, they can respond dynamically to user inputs on individual controllable rotary knobs 1 via the controlling units 24. Furthermore, a daisy chain cable connection for power supply or, respectively, for communication among individual rotary knobs 1 is also feasible.

According to a further alternative embodiment, the communication units 23 of the controllable control dial 1 according to the invention are, in this case, configured for independently establishing a network according to current standards such as, e.g., LTEm, BLE, Bluetooth, 6LoWPAN, etc., wherein the network hub 18 or, respectively, the interface 17 is omitted. Furthermore, it is possible, for example, to implement an inductive charging unit in the rotary knob 1. By a detachable separation between the base 2 (might also be a further base) and remaining parts of the rotary knob 1, the rotary knob 1 can be placed in a charging station or, respectively, a simple battery replacement can be performed. The rotary knob 1 may contain both a cable connection for the power supply and an antenna for magnetic resonance charging or, respectively, power supply. Furthermore, the energy storage device can also be charged by recuperation by utilizing a rotary motion which is applied by the user to the rotary knob 1 in order to generate electricity by means of the drive unit 3. This recuperation function can be activated, for example, only when the rotary knob 1 is turned by the user. Other methods of energy production include energy harvesting methods by means of sound, temperature or directional electromagnetic waves.

According to an embodiment, controllable rotary knobs 1 according to the invention can also be used as input devices irrespective of an existing rotary knob. In this case, the connection of the controllable rotary knob 1 to a rotary knob shaft 12 is omitted. In this embodiment, changes in the position of the controllable rotary knob 1 are registered via a position encoder unit 20 in analogy to the above-mentioned embodiments, and inputs are registered by the display and input unit 14. An application of this embodiment within a group of controllable rotary knobs 1 may occur along the lines of FIG. 6 or, respectively, along the lines of the last-mentioned embodiment of the network connection. In this case, a central drive unit 3 (see FIG. 2) may also be used, which can be arranged axially, wherein, in this case, the connecting element 6 (see FIG. 2) is omitted, since no rotary shaft is inserted.

In an embodiment with wired or wireless data connection or, respectively, power supply and without connecting element 6, the rotary knob 1 according to the invention may, in addition, have an energy storage device for which more space within the rotary knob 1 is available due to the omitted connecting element 6. As a result, the advantage is obtained that an energy storage device with higher capacity can be installed. The energy storage device can be provided in the form of a battery or, if it is rechargeable, for example in the form of a rechargeable battery. The cable connections can be designed, for example, as pogo-pin connections.

Furthermore, in the embodiments with or without connecting element 6, the rotary knob 1 according to the invention may comprise an RFID antenna, which is arranged, for example, in or behind the transparent surface 21 or within the base 2. As a result, among other things, the energy storage unit can be charged wirelessly. Such a design of the rotary knob 1 is advantageous especially in applications in the field of clean rooms or in food processing, medical or pharmaceutical applications. Furthermore, this results in the possibility that the rotary knob 1 according to the invention can be locked or released by means of the RFID antenna, for example, using an NFC token. This can be done via an acknowledgement as well as simply as a result of the proximity of a token.

If a rotary knob is replaced with a controllable rotary knob 1 according to the invention on a device, its position on the device can be allocated in a software application which is retrieved on the end device 19, and a previously stored setting of the controllable rotary knob 1 can be restored if desired. Continuous manipulation in real time and monitoring of the rotary knobs, even from a remote place/site, may also occur. By combining several controllable rotary knobs 1 according to the invention in a network, complex settings can thus also be stored and retrieved.

Controllable rotary knobs 1 according to the invention provide the possibility to be used on rotary knobs both with and without a mechanical stopper, since a zero position can be set by means of the position encoder unit 20.

According to a further embodiment, a further position encoder unit 20 may be provided in addition in order to increase the accuracy and safety of the position determination. This variant is advantageous especially for applications with high safety requirements (personal safety, machine safety). Optionally, this further position encoder unit 20 might also be a separate galvanic unit (potentiometer, rotary switch . . . ) which can be made available to the outside via the control lines and is designed such that it will neither enlarge the control dial 1 nor impede the assembly on smooth, flat surfaces.

Furthermore, by brief (torque) pulses of the drive unit 3, a tactile feedback can be generated for a user, for example, to indicate the zero position or the stopper.

The software-controlled regulation of individual controllable rotary knobs 1 according to the invention of a network provides the possibility to establish a linear or non-linear mutual dependence between several controllable rotary knobs 1. In this case, the movement of a controllable rotary knob 1 by a user will bring about an arbitrary predefined movement of one or more further controllable rotary knobs 1 of the network.

In addition, software-controlled positional changes of controllable rotary knobs 1 may be provided with a smoothing or the definition of (pending) limiting values so that, for example, distortions due to level changes are minimized.

Furthermore, the design according to the invention of the rotary knob 1 allows two rotary knobs 1 or more to be arranged on top of each other on the base 2 along a common axis of rotation, for example, using suction cups. As a result, coaxial rotary knobs 1 can be realized, and more rotary knobs 1 can be mounted on a limited base area.

According to a further embodiment of the rotary knob 1, the rotary knob 1 comprises the rotary switch 16 with the rotary knob shaft 12, wherein the connecting element 6 is connected to the rotary knob shaft 12. The connecting element 6 can be connected to the operating element 5 directly or via the planetary gear. Preferably, the rotary switch 16 is arranged with the rotary knob shaft 12 above the base 2. As a result, the advantage is obtained that the rotary knob 1 can fully replace a conventional rotary switch 16. In addition, by arranging the rotary switch 16 with the rotary knob shaft 12 above the base 2, a small overall height of the rotary knob 1 can be realized.

The invention claimed is:

1. A controllable rotary knob which comprises at least one base, at least one drive unit rigidly connected to the base, at least one transmission, and an operating part, wherein the operating part is configured as a housing surrounding the drive unit and the transmission, wherein the transmission establishes a connection between the drive unit and the operating part, wherein the drive unit has an axially symmetric structure and can be arranged concentrically about a rotary knob shaft, and wherein the drive unit and the operating part being arranged coaxially to one another.

2. The controllable rotary knob according to claim 1, wherein the drive unit is any one from the following group: a hollow-shaft DC motor; a number of stepping motors; a number of synchronous or asynchronous motors.

3. The controllable rotary knob according to claim 1, wherein the operating part is removable from the controllable rotary knob.

4. The controllable rotary knob according to claim 1, wherein the transmission is a planetary gear which comprises at least one planet gear.

5. The controllable rotary knob according to claim 4, wherein the at least one planet gear has a fixed axis of rotation with regard to the base.

6. The controllable rotary knob according to claim 4, wherein the drive unit has at least one rotor which is connected to the at least one planet gear by a drive shaft, or by a sun gear.

7. The controllable rotary knob according to claim 4, wherein the planetary gear comprises a ring gear connected to the operating part, wherein the at least one planet gear engages said ring gear.

8. The controllable rotary knob according to claim 4, wherein the controllable rotary knob comprises a connecting element, and the planetary gear comprises one or two or more planet gears which are engaged with one another, and at least one planet gear engages the connecting element by a sun gear connected to the connecting element, or by a gear-shaped design of the connecting element.

9. The controllable rotary knob according to claim 4, wherein the controllable rotary knob comprises a connecting element directly connected to the operating part.

10. The controllable rotary knob according to claim 1, wherein the controllable rotary knob comprises a position encoder unit which is connected to any one of the operating part, the at least one rotor of the drive unit, and the transmission, and is configured for generating position information.

11. The controllable rotary knob according to claim 1, wherein the controllable rotary knob comprises a control unit configured for receiving control information, processing the control information, and controlling the drive unit on the basis of the control information.

12. The controllable rotary knob according to claim 1, wherein the controllable rotary knob comprises at least one display and input unit which includes at least one display element and/or input element and is configured for processing display information and controlling the at least one display element on the basis of the display information and generating input information.

13. The controllable rotary knob according to claim 10, wherein the controllable rotary knob comprises a communication unit as well as a controlling unit, wherein the controlling unit is connected to the position encoder unit, the control unit, the display and input unit and the communication unit and is configured for receiving position information from the position encoder unit, input information from the display and input unit and control information, display information, position information as well as input information from the communication unit, for generating control information and display information and for transmitting control information to the control unit, display information to the display and input unit and display information, position information, control information and input information to the communication unit, wherein the communication unit is configured for the exchange of control information, position information, display information and input information with the controlling unit and for the wireless or wired communication of control information, position information, display information and input information to a data network.

14. The controllable rotary knob according to claim 8, wherein the controllable rotary knob comprises a position encoder unit which is connected to the connecting element.

15. The controllable rotary knob according to claim 12, wherein the display element is any one of an LED ring, an OLED display, an eReader display or a TFT display.

16. The controllable rotary knob according to claim 12, wherein the input element is any one of a touch operating panel, a proximity sensor, a sensing device or a switch.

* * * * *